US005711047A

United States Patent [19]

Armaly, Jr.

[11] Patent Number: 5,711,047

[45] Date of Patent: Jan. 27, 1998

[54] SPECIALTY PAINT ROLLER COVER

[75] Inventor: John W. Armaly, Jr., Walled Lake, Mich.

[73] Assignee: Armaly Brands, Walled Lake, Mich.

[21] Appl. No.: 662,205

[22] Filed: Jun. 12, 1996

[51] Int. Cl.[6] ..... B05C 17/02

[52] U.S. Cl. ..... 15/230.11; 492/13; 492/19

[58] Field of Search ..... 15/210.5, 230, 15/230.11, 230.12, 230.13, 230.19; 492/13, 17, 19, 30, 44

[56] References Cited

U.S. PATENT DOCUMENTS 5,206,979 5/1993 Campbell .

FOREIGN PATENT DOCUMENTS 75807 5/1953 Denmark ..... 15/230.11

1105771 4/1961 Germany ..... 15/230.11

*Primary Examiner*—Mark Spisich

*Attorney, Agent, or Firm*—Oblon, Spivak, McClelland, Maier & Neustadt, P.C.

[57] ABSTRACT

A paint roller cover which can provide a "rag" finish. This paint roller cover includes an inner core with first and second separate core elements. A cover element covers the inner core. An adhesive formed on outer edges of the first and second separate core elements secures portions of the roller cover to the first and second separate core elements. A pressing member holds the inner core elements together for mounting the paint roller cover onto a paint roller holder. A painter can then impart a desired amount of twist onto portions of the roller cover, to select a desired finish achieved by such a paint roller cover. This paint roller cover can also be mounted on a conventional cage assembly paint roller holder, and thus is very easy and inexpensive to use.

15 Claims, 1 Drawing Sheet

SPECIALTY PAINT ROLLER COVER

BACKGROUND OF THE INVENTION

1. Field of the Invention

The present invention is directed to a specialty paint roller cover which can provide a "rag rolling" finish with a simple application.

2. Discussion of the Background

The use of specialty finishes on interior walls is becoming increasingly popular to create "faux" finishes.

One specific type of specialty or "faux" finish is known as "rag rolling". Such a "rag rolling" application process may be either of a negative type of application or a positive type of application. The positive application process of "rag rolling" requires utilizing a piece of cloth (i.e., a "rag") to apply paint over a surface. In such a process, the "rag" is dipped in paint, and is then loosely twisted. The rag containing the paint is then rolled by hand down the wall from the top to the bottom. This is a positive type of application as paint is being applied to the wall. The type of application referred to as the negative application is one in which the paint is first completely applied to the wall, and then the loosely twisted rag is rolled over the paint to remove part of the paint.

This type of "rag rolling" finishing technique provides a specialty or "faux" finish onto a painted surface.

However, such a "rag rolling" process, in either the positive or negative application methods, is a complicated process which requires great effort on the part of the painter. It is time consuming for the painter to constantly dip the rag in paint or remove the paint from the rag, and to be constantly twisting the rag. It is also time consuming and difficult for the painter to move the rag from the top of the wall to the bottom.

A particular type of paint roller for achieving such a "rag rolling" is disclosed in U.S. Pat. No. 5,206,979. This patent discloses a paint roller which can achieve a type of "rag rolling" finish.

The drawback with the device disclosed in U.S. Pat. No. 5,206,979 is that it requires a specialized holder for the paint roller cover. That is, the device disclosed in this patent cannot be utilized with a conventional cage assembly paint roller holder, but instead requires a specialized paint roller holder. Therefore, the use of this device requires a large investment in cost.

SUMMARY OF THE INVENTION

Accordingly, one object of the present invention is to provide a novel paint roller cover which can achieve a "rag rolling" finish.

The paint roller cover of the present invention can achieve such a "rag rolling" finish by a simple application which is easy for a painter to utilize and which is inexpensive.

In order to achieve such objects of the present invention, the paint roller cover of the present invention includes an inner core which has first and second separate elements. A cover element is formed to cover this inner core. This cover element is typically formed of a cloth or other fabric which achieves the rag rolling finish. Further, an adhesive is formed over outer surfaces of the first and second separate core elements to secure a portion of the cover element against the first and second separate core elements.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
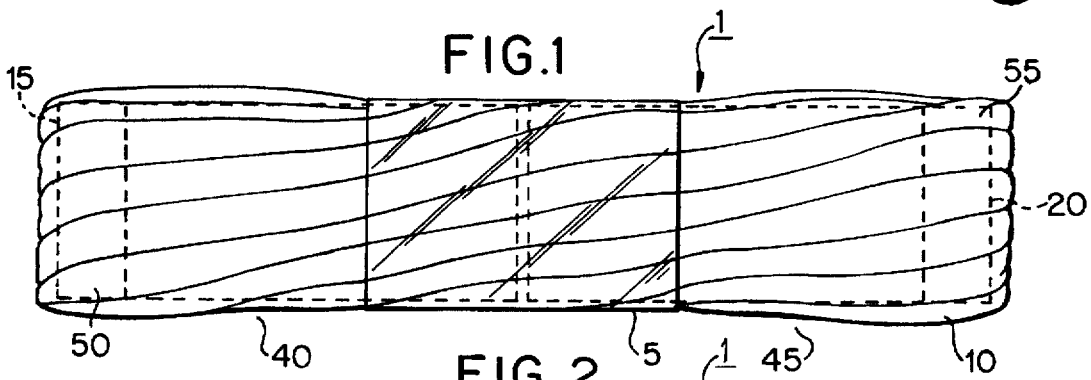
FIG. 1 shows the novel paint roller cover according to the embodiment of the present invention.

Referring now to the drawings, wherein like reference numerals designate identical or corresponding parts throughout the several views, and more particularly to FIG. 1 thereof, the paint roller cover 1 of the present invention is shown.

Figure 3:
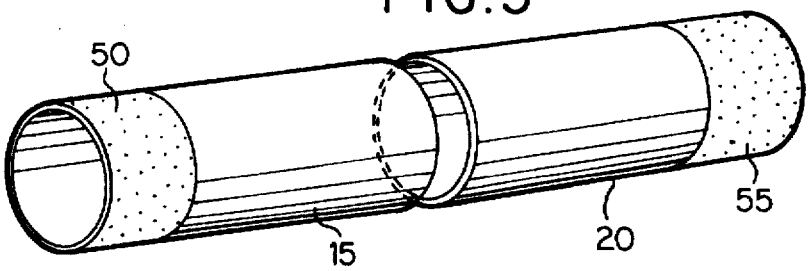
FIG. 3 shows the inner core elements of the paint roller cover of the present invention.

As is shown in FIG. 1, the paint roller cover 1 of the present invention includes a cover element 10 formed over an inner core formed of two elements 15, 20 (shown in the dotted lines), which is shown in further detail in FIG. 3. This cover 10 will typically be formed of a 100% cotton polo material. However, other fabrics could be utilized for the cover 10. Furthermore, placed in a center of the paint roller cover 1 to cover a portion of the roller cover 10 is a pressing member 5. This pressing member 5 presses the cover 10 tightly against the inner core. This pressing member 5 may typically be a label element or a piece of adhesive tape.

FIG. 3 shows the inner core of the paint roller cover 1 of the present invention, and shows that the inner core is formed of two distinct core elements 15 and 20. In the present invention the inner core is divided into two separate elements 15 and 20, which may be formed of a fiber core, plastic or cardboard, as examples, and the cover 10 is formed over the separate core elements 15 and 20. Formed on outer edges of both of core elements 15, 20 is a respective lay down of adhesive 50, 55. This adhesive 50, 55 secures opposite outer edges of the cover 10 to the inner core elements 15 and 20. This layer of adhesive 50, 55 may be implemented by adhesive transfer strips, two-sided tape or other types of adhesive transfer agents. The pressing member 5 will typically be positioned so that a center of the pressing member 5 is over the gap between the inner core elements 15 and 20.

Figure 4:
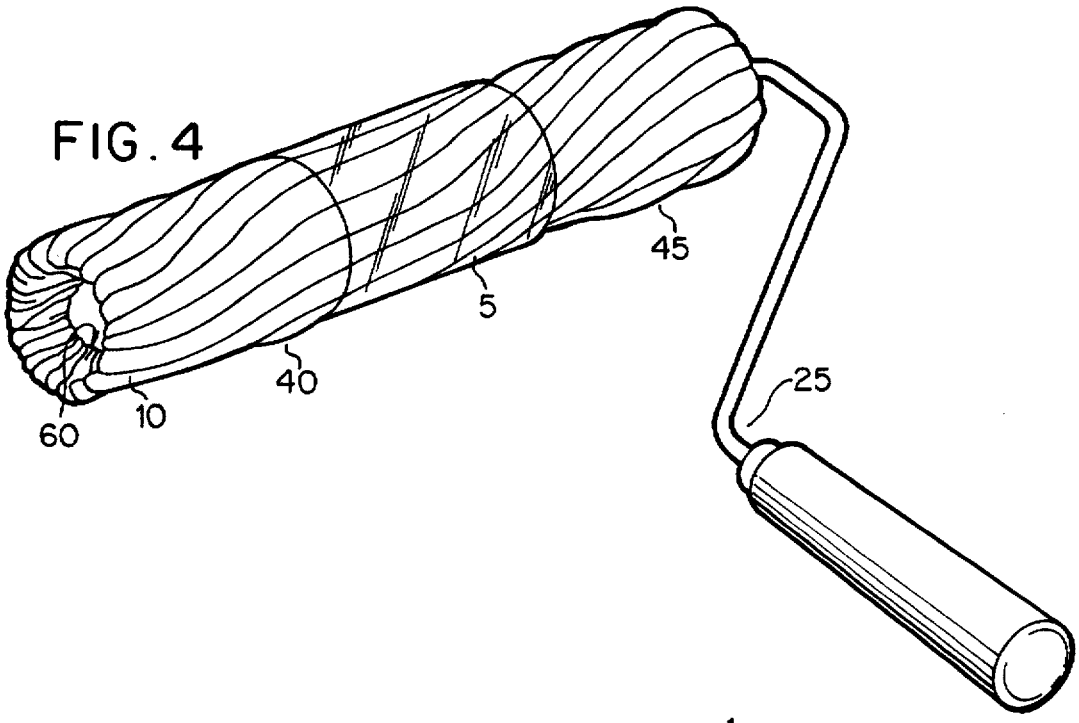
FIG. 4 shows the paint roller cover utilized on a paint roller cover handle.

As shown in FIG. 4, the paint roller cover 1 of the present invention can be mounted on a conventional cage assembly paint roller assembly 25. As also shown in FIG. 4, edges of the paint roller cover 10 will be tightly bunched together by an elastic member 60 positioned inside of the inner core elements 15, 20. This elastic member 60 secures that the edges of the paint roller cover 10 are tightly held to not adversely influence the desired finish at the edges of paint roller cover 1.

The operation and use of the paint roller cover 1 of the present invention will now be further detailed.

As noted above, the paint roller cover 1 of the present invention is designed to be slid onto and mounted on a conventional cage assembly paint roller holder 25. The two inner core elements 15, 20 are tightly held by the cage assembly paint roller holder 25, particularly as such a cage assembly paint roller holder 25 is formed of bowed wire elements to hold the paint roller cover 1.

The painter can then perform a testing of the pattern provided by the twist of the cover 10 by placing paint on the cover 10 and then painting a small surface of the wall to be painted or painting a piece of cardboard, etc. If the pattern provided by the paint roller cover 1 is not to the painter's liking, the painter can change the twist amount in the cover 10. This is done in the present invention by the painter simply twisting the outer portion 40 of the roller cover 10 in one direction, and twisting the inner portion 45 of the cover 10 in an opposite direction.

Figure 2:
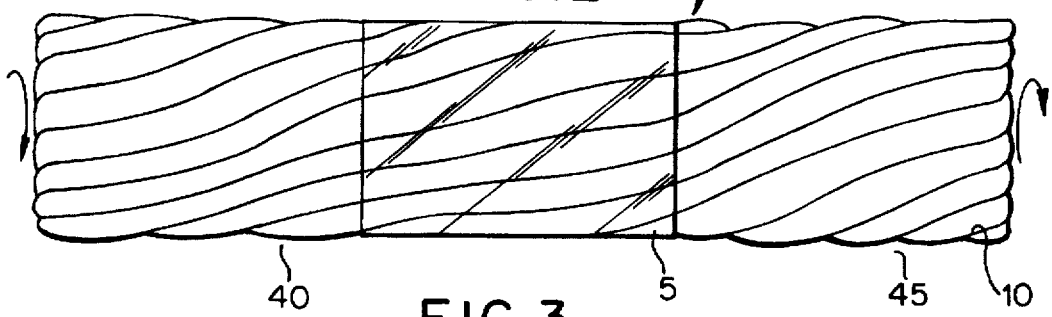
FIG. 2 shows the novel paint roller cover in a further twisted form according to the embodiment of the present invention.

The result of this twisting operation is shown in FIG. 2. That is, FIG. 2 shows the paint roller cover 1 of the present invention in which, with reference to FIG. 1, the outer portion 40 has been twisted in a clockwise direction and the inner portion 45 has been twisted in a counterclockwise direction, as indicated by the arrows in FIG. 2. This results in essentially increasing the twist amount in the cover 10, which thereby changes the finish provided by using paint roller cover 1. After making this adjustment, the painter can then again test to determine whether the paint roller cover 1 is providing the desired finish. Further adjustments by manually twisting the two portions 40, 45 of the paint roller cover 1 can continue to be performed until the desired finish is obtained.

In the present invention, by virtue of the inner core being separated into first and second elements 15, 20, by virtue of the adhesive portions 50, 55 pressing the roller cover 10 against the inner core elements 15, 20, and by virtue of inner core elements 15, 20 being held by the cage assembly paint roller holder 25, a desired amount of twist can be implemented in the cover 10.

In the present invention, the pressing member 5 is provided to assist in mounting the paint roller cover 1 on the cage assembly paint roller holder 25. That is, the pressing member 5 holds the two inner core elements 15, 20 together while the paint roller cover 1 is being mounted on the cage assembly paint roller holder 25, to make this mounting easier. After the paint roller cover 1 is secured on the cage assembly paint roller holder 25, the pressing member 5 is removed.

The paint roller cover of the present invention can easily provide a "ragged" finish with an easy to use paint roller cover which can be mounted on a conventional cage assembly paint roller holder 25.

Obviously, numerous modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A paint roller cover comprising:

an inner core including first and second separate core elements;

a cover element formed to cover the inner core; and an adhesive formed on edges of the first and second separate core elements for securing portions of the cover element against the first and second separate core elements.

2. The paint roller cover according to claim 1, wherein the cover element is formed of a cotton fabric.

3. The paint roller cover according to claim 1, wherein the adhesive includes adhesive transfer strips.

4. The paint roller cover according to claim 1, wherein the adhesive is a two-sided adhesive tape.

5. The paint roller cover according to claim 1, further comprising a pressing member formed over portions of the first and second separate core elements.

6. A paint roller assembly, comprising:

a paint roller cage frame holder;

a paint roller cover, the paint roller cover comprising:

an inner core including first and second separate core elements;

a cover element formed to cover the inner core; and an adhesive formed on edges of the first and second separate core elements for securing portions of the cover element against the first and second separate core elements.

7. The paint roller assembly according to claim 6, wherein the cover element is formed of a cotton fabric.

8. The paint roller assembly according to claim 6, wherein the adhesive includes adhesive strips.

9. The paint roller assembly according to claim 6, wherein the adhesive is a two-sided adhesive tape.

10. The paint roller assembly according to claim 6, further comprising a pressing member formed over portions of the first and second separate core elements.

11. A paint roller cover comprising:

an inner core means including first and second separate core elements;

a cover means for covering the inner core means; and an adhesive means formed on edges of the first and second separate core elements for securing portions of the cover means against the first and second separate core elements.

12. The paint roller cover according to claim 11, wherein the cover means is formed of a cotton fabric.

13. The paint roller cover according to claim 11, wherein the adhesive means includes adhesive strips.

14. The paint roller cover according to claim 11, wherein the adhesive means is a two-sided adhesive tape.

15. The paint roller according to claim 11, further comprising a pressing means formed over portions of the first and second separate core elements.

* * * * *